United States Patent [19]

Smith et al.

[11] Patent Number: 4,776,273

[45] Date of Patent: Oct. 11, 1988

[54] FUZE ARRANGEMENT FOR MISSILES

[75] Inventors: Cyril Smith, Bordon; Anthony R. Price, Farnham, both of England

[73] Assignee: The Marconi Company Limited, England

[21] Appl. No.: 872,456

[22] Filed: Jan. 17, 1978

[51] Int. Cl.[4] ..... F42C 11/00

[52] U.S. Cl. ..... 102/206; 102/213; 102/216

[58] Field of Search ..... 102/200, 206, 207, 211, 102/212, 215, 216

[56] References Cited

U.S. PATENT DOCUMENTS 3,447,462 6/1969 Mies ..... 102/206

3,877,382 4/1975 Kalmus ..... 102/211

*Primary Examiner*—Charles T. Jordan

*Attorney, Agent, or Firm*—Kirschstein, Kirschstein, Ottinger & Israel

[57] ABSTRACT

An impact fuze arrangement for a missile in which an electromagnetic field is set up within a compartment in the body of the missile and a warhead detonating signal is generated if the field intensity varies by more than a predetermined amount, as will happen due to distortion of the compartment on impact of the missile on a target. Fields may be set up within a plurality of compartments and warhead detonation may be made conditional on distortion of more than one of these compartments.

3 Claims, 4 Drawing Sheets

FUZE ARRANGEMENT FOR MISSILES

The present invention relates to fuze arrangements for missiles.

According to the present invention a fuze arrangement for a missile comprises means within the body of the missile to establish an electric or magnetic or an electromagnetic field within a compartment defined by elements of the structure of the missile, which compartment will be distorted by movement or distortion of some at least of said elements of structure upon impact of said missile, and means responsive to variation of said electric or magnetic field resulting from said movement of distortion to detonate the warhead of said missile.

A plurality of substantially separate compartments may be provided, and said means to detonate the warhead may be arranged to respond only if a predetermined variation of the field in a predetermined number of these compartments occurs.

Figure 1:
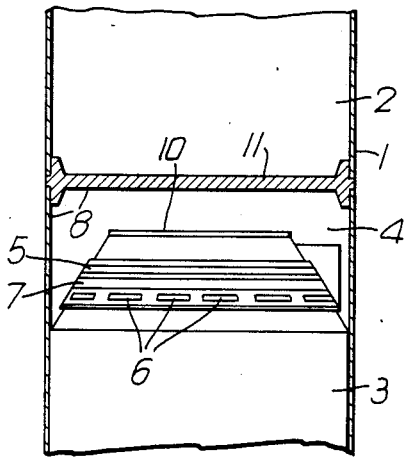
Figure 2:
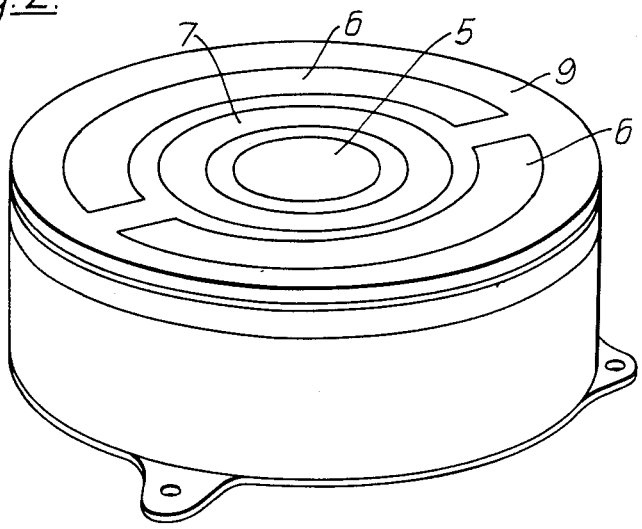
Figure 3:
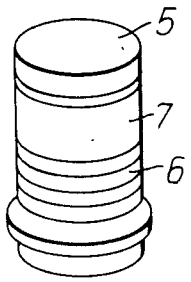
Figure 4:
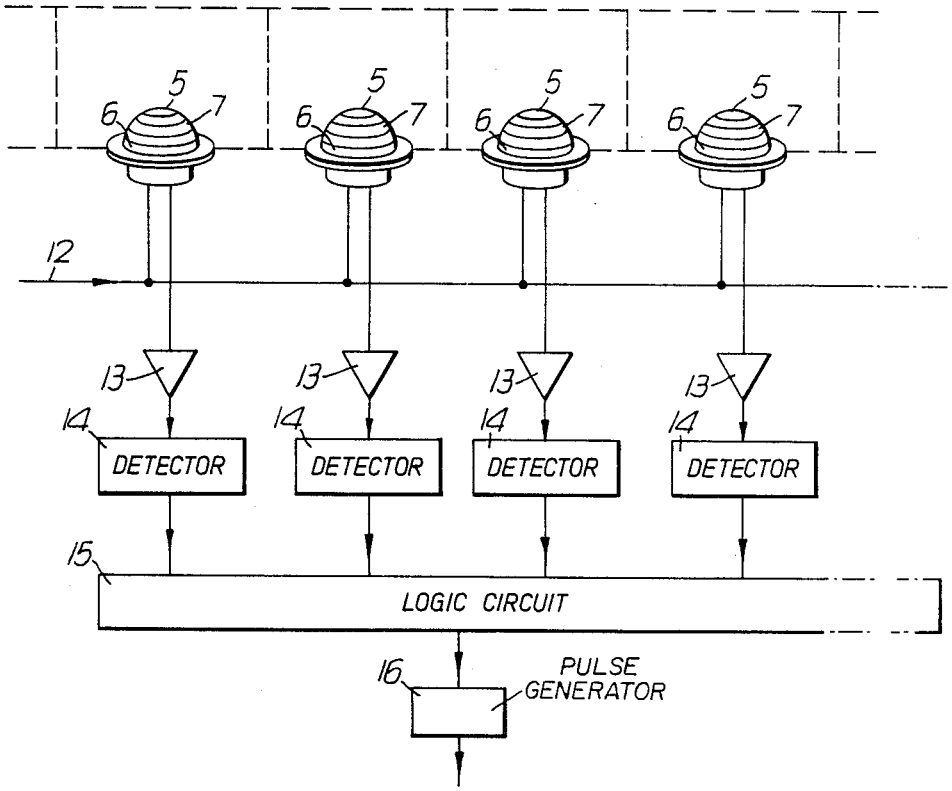
Figure 5:
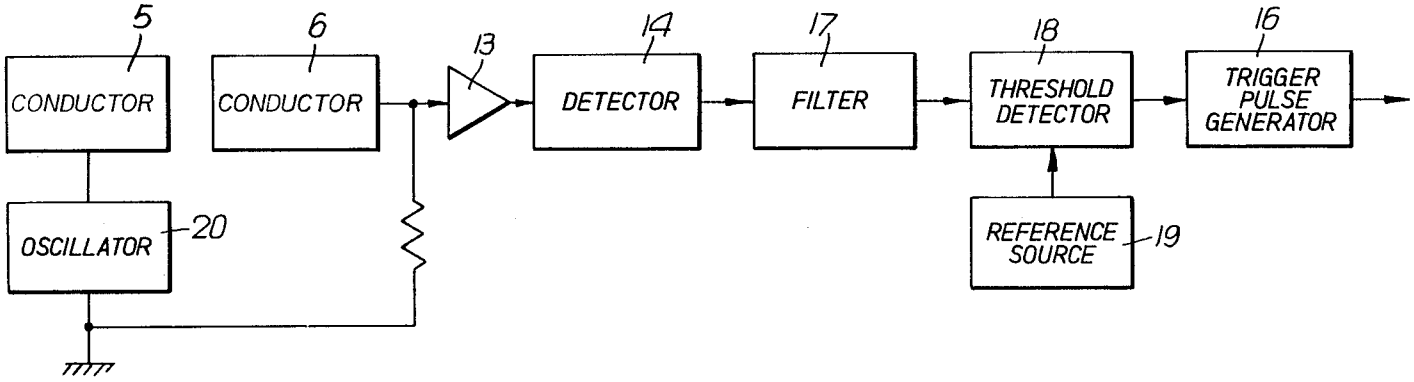
Figure 6:
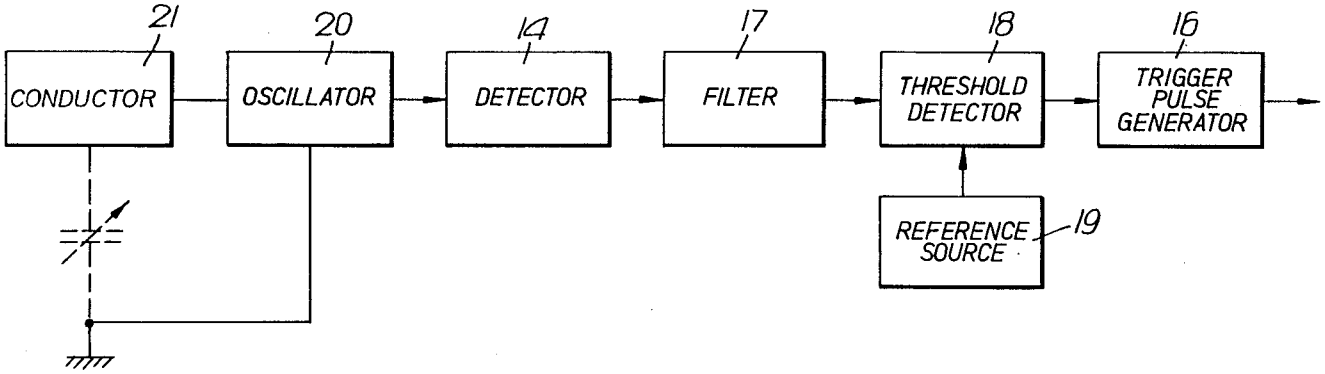

A fuze arrangement for a missile will now be described with reference to the accompanying drawings of which:

FIG. 1 shows a partial longitudinal section of a missile body incorporating the fuze arrangement, FIGS. 2 and 3 show details of different fuze arrangements, and FIGS. 4, 5 and 6 show schematically respective electric circuits of said fuze arrangements.

Referring first to FIG. 1 of the drawings the missile body comprises a generally cylindrical outer skin 1 defining a forebody 2 and a warhead case 3, which are separated by an intermediate portion providing a compartment 4 in which an electric or a magnetic or an electromagnetic field is set up. As shown in the drawing an electromagnetic field is set up between a conductive ring 5 and a plurality of conductive strips 6, the intensity of this field being influenced by a conductive ring 7 and the walls 8 of the compartment 4.

This electromagnetic field, which may be an oscillatory field set up by an electric oscillator circuit (not shown in FIG. 1), will remain essentially undisturbed by events outside the missile body 1, such as nearby explosions, projectiles passing close by the missile, or by varying electric or magnetic fields outside the compartment 4, but will vary significantly when the missile strikes a target and the elements of the missile structure are distorted by the impact. The variation of the electric field may either be sensed by the oscillator circuit as a change in the loading of its output circuit or may be sensed by a separate receiver circuit responsive to some measure of the electric field. In either case a predetermined change in the electric field within the compartment 4 may be arranged to trigger a detonator (not shown in FIG. 1) for the warhead of the missile. The extent of change in field required to trigger the detonator may be set so as to avoid false triggering by projectiles or fragments from nearby explosions penetrating the compartment 4.

The conductors 5, 6 and 7 may be formed as printed copper conductors on a substrate which is bonded around the conical forward section of the warhead 3, the connections to the different conductor actions being made by way of a screened layer beneath the conductors 5, 6 and 7.

Referring also to FIG. 2 the electric field may alternatively be set up between conductors 5, 6 and 7 which are arranged on a planar substrate 9, this susbstrate being bonded for example to the forward face 10 of the warhead 3. The principal portion of the missile structure which would influence the field in the event of impact would then be the bulkhead 11.

Other arrangements of the conductors 5, 6 and 7 are shown in FIGS. 3 and 4, where the substrates are respectively cylindrical and hemispherical. These arrangements can be made physically quite small, and can for example be secured to the walls of respective compartments within the missile structure.

As shown in FIG. 4 the conductor arrangements may be placed in a plurality of individual compartments 4, all the conductors 5 being connected to a common oscillator (not shown) by way of the line 12 and the respective conductors 6 being connected by way of respective amplifiers 13 and detectors 14 to a logic circuit arrangement 15. Triggering of a detonator by a pulse generator 16 may then be made conditional on a change of field in a given number of the compartments 4, or compartments in predetermined locations, so that, say, shrapnel damage will not trigger the detonator whereas impact distortion of the missile will. The compartments 4 will of course not in general be regular in size or shape, or rectangular, as shown in FIG. 4.

Referring now to FIG. 5 the conductor 5 of the arrangement shown in, say, FIG. 1 is connected to an output of an oscillator 20 operating at a frequency of the order of, say, one megaHertz. The conductor or conductors 6 is or are connected by way of an amplifier 13 to a detector or rectifier 14 and thence by way of a filter 17 to a threshold detector 18, where the signal level is compared with a reference level from a source 19. The output of the threshold detector 18 is connected to a trigger pulse generator 16.

In the arrangement shown in FIG. 6, where the same reference numerals are used as far as possible for corresponding circuits, the change in loading on the oscillator 20 due to a single conductor 21 when the missile structure around that conductor 21 is distorted is utilised to operate the trigger pulse generator 16.

The fuze arrangement can be made more resistant to premature operation resulting from fragment damage by suitable choice of timing constants in the filters 17, so as to distinguish between high-velocity fragments and the slower onset of structural distortion as the missile impacts.

We claim:

1. A missile fuze arrangement comprising a missile body having structural members defining at least one compartment within the missile body which is deformable upon impact of said missile on a target, means to establish an electromagnetic field within said compartment, and means responsive to a change in the intensity of said electromagnetic field upon deformation of said compartment to generate a warhead detonating signal.

2. A missile fuze arrangement in accordance with claim 1 wherein said means to establish an electromagnetic field within the compartment comprises a conductive member that is electrically insulated from at least some of said structural members defining said compartment, and electric oscillation generator means having an output connected to said conductive member.

3. A missile fuze arrangement in accordance with claim 1 wherein the structural members define a plurality of compartments within the missile body, and there are provided means to establish respective electromagnetic fields within each of said plurality of compartments, and said means to generate a warhead detonating signal is responsive to a change in the intensity of said electromagnetic fields in a predetermined number of said compartments.

* * * * *